US011809098B2

(12) United States Patent
Shimodaira et al.

(10) Patent No.: US 11,809,098 B2
(45) Date of Patent: Nov. 7, 2023

(54) CLEANING DEVICE AND IMAGE FORMING APPARATUS

(71) Applicant: FUJIFILM Business Innovation Corp., Tokyo (JP)

(72) Inventors: Akira Shimodaira, Kanagawa (JP); Tomoya Oki, Kanagawa (JP); Naoya Mitamura, Kanagawa (JP)

(73) Assignee: FUJIFILM Business Innovation Corp., Tokyo (JP)

( * ) Notice: Subject to any disclaimer, the term of this patent is extended or adjusted under 35 U.S.C. 154(b) by 0 days.

(21) Appl. No.: 17/902,888

(22) Filed: Sep. 4, 2022

(65) Prior Publication Data

US 2023/0305446 A1 Sep. 28, 2023

(30) Foreign Application Priority Data

Mar. 28, 2022 (JP) ..... 2022-052253

(51) Int. Cl.
*G03G 15/16* (2006.01)

(52) U.S. Cl.
CPC ..... *G03G 15/161* (2013.01)

(58) Field of Classification Search
CPC .... G03G 15/065; G03G 15/161; G03G 5/047; G03G 5/06; G03G 21/17; G03G 21/1825; G03G 21/186
USPC ..... 399/101, 123, 343, 350
See application file for complete search history.

(56) References Cited

U.S. PATENT DOCUMENTS

2018/0196387 A1* 7/2018 Watanabe ..... G03G 21/0017

FOREIGN PATENT DOCUMENTS

JP 2005173351 6/2005
JP 2021-144135 * 9/2021

* cited by examiner

*Primary Examiner* — Hoan H Tran
(74) *Attorney, Agent, or Firm* — JCIPRNET

(57) ABSTRACT

A cleaning device includes a cleaning member that removes toner from a surface of an image holder by bringing an upper end portion into contact with the surface from a downstream side in a rotation direction of the image holder, a housing that supports the cleaning member and that stores the toner removed from the surface of the image holder by the cleaning member, and a transport member that is provided in the housing and that transports the toner stored in the housing to an outside of the housing at the same height as a contact portion of the cleaning member that comes into contact with the surface of the image holder or at a position above the contact portion.

20 Claims, 6 Drawing Sheets

CLEANING DEVICE AND IMAGE FORMING APPARATUS

CROSS-REFERENCE TO RELATED APPLICATIONS

This application is based on and claims priority under 35 USC 119 from Japanese Patent Application No. 2022-052253 filed Mar. 28, 2022.

BACKGROUND (i) Technical Field

The present disclosure relates to a cleaning device and an image forming apparatus.

(ii) Related Art

Disclosed in JP2005-173351A is a cleaning device including a cleaning member that comes into contact with a surface of a cleaning target member and that relatively moves on the surface to remove an adhering substance, and a collection container that includes an opening facing the cleaning target member on a cleaning member upstream side so that the adhering substance removed by the cleaning member is collected in the vicinity of the cleaning member. In the collection container, a powder supply unit for supply of a powder onto the cleaning target member is provided.

SUMMARY

Meanwhile, in the case of a configuration in which toner different from toner removed from a surface of an image holder is supplied to, as a lubricant material, a contact portion of a cleaning member that comes into contact with the surface, the amount of toner to be used is increased.

Aspects of non-limiting embodiments of the present disclosure relate to a cleaning device and an image forming apparatus that reduce the amount of toner to be used and suppress poor cleaning of an image holder in comparison with a configuration in which toner different from toner removed from a surface of an image holder is supplied to, as a lubricant material, a contact portion of a cleaning member that comes into contact with the surface.

Aspects of certain non-limiting embodiments of the present disclosure overcome the above disadvantages and/or other disadvantages not described above. However, aspects of the non-limiting embodiments are not required to overcome the disadvantages described above, and aspects of the non-limiting embodiments of the present disclosure may not overcome any of the disadvantages described above.

According to an aspect of the present disclosure, there is provided a cleaning device including a cleaning member that removes toner from a surface of an image holder by bringing an upper end portion into contact with the surface from a downstream side in a rotation direction of the image holder, a housing that supports the cleaning member and that stores the toner removed from the surface of the image holder by the cleaning member, and a transport member that is provided in the housing and that transports the toner stored in the housing to an outside of the housing at the same height as a contact portion of the cleaning member that comes into contact with the surface of the image holder or at a position above the contact portion.

BRIEF DESCRIPTION OF THE DRAWINGS

Exemplary embodiment(s) of the present invention will be described in detail based on the following figures, wherein.

DETAILED DESCRIPTION

Hereinafter, an image forming apparatus according to an exemplary embodiment will be described with reference to the drawings.

Overall Configuration of Image Forming Apparatus

Figure 1:
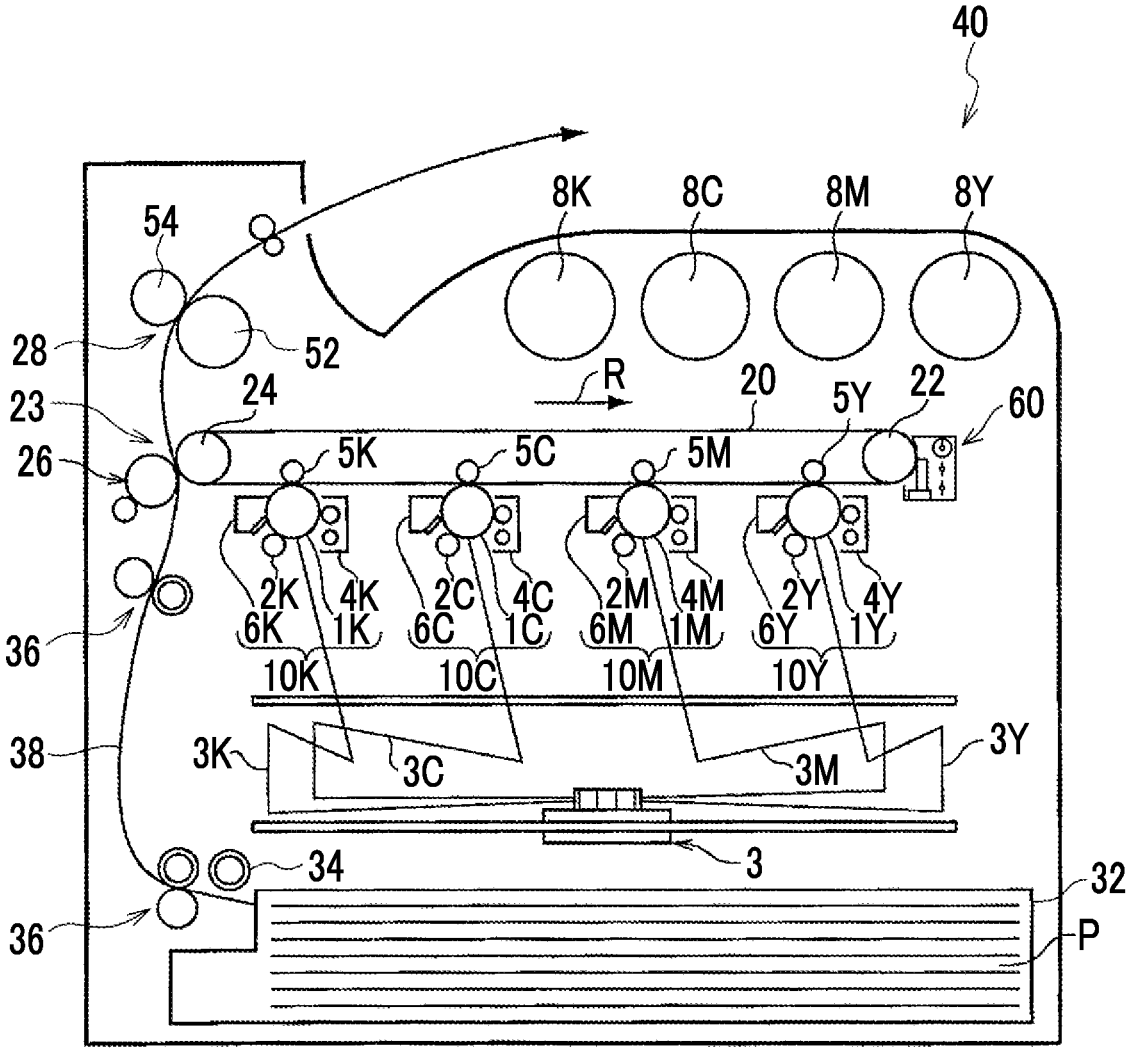
FIG. 1 is a schematic configuration view showing an example of an image forming apparatus according to an exemplary embodiment.

FIG. 1 is a schematic configuration view showing an example of the configuration of the image forming apparatus according to the exemplary embodiment. As shown in FIG. 1, an image forming apparatus 40 includes first to fourth electrophotographic image forming units 10Y, 10M, 10C, and 10K. The first to fourth image forming units 10Y, 10M, 10C, and 10K output images of respective colors, which are yellow (Y), magenta (M), cyan (C), and black (K), based on image data.

The plurality of image forming units 10Y, 10M, 10C, and 10K are arranged at predetermined intervals along an intermediate transfer belt 20 which will be described later. Each of the image forming units 10Y, 10M, 10C, and 10K is an example of an image forming unit.

In FIG. 1, above the image forming units 10Y, 10M, 10C, and 10K, the intermediate transfer belt 20 that extends over the image forming units 10Y, 10M, 10C, and 10K and has an endless belt-like shape is disposed. The intermediate transfer belt 20 is wound around a drive roller 22 and a support roller 24 that are disposed to be separated from each other. In addition, the intermediate transfer belt 20 rotates in a direction from the first image forming unit 10Y to the fourth image forming unit 10K as shown by an arrow R.

A force is applied to the support roller 24 in a direction away from the drive roller 22 by a spring or the like (not shown), and a tension is applied to the intermediate transfer belt 20 supported by the drive roller 22 and the support roller 24. In addition, a cleaning device 60, which faces the drive roller 22 with the intermediate transfer belt 20 interposed therebetween, is provided outside the intermediate transfer belt 20. The cleaning device 60 removes toner remaining on a surface 20S (refer to FIG. 2) of the intermediate transfer belt 20. Note that the configuration of the cleaning device 60 will be described later.

Toner including toner of four colors (yellow, magenta, cyan, and black) contained in toner cartridges 8Y, 8M, 8C, and 8K is supplied to respective developing devices 4Y, 4M, 4C, and 4K of the image forming units 10Y, 10M, 10C, and 10K.

The first to fourth image forming units 10Y, 10M, 10C, and 10K have the same configuration as each other. Therefore, in the following description, the configuration of the first image forming unit 10Y that is disposed on an upstream side in a rotation direction of the intermediate transfer belt 20 and that forms a yellow image will be described and the configurations of the second to fourth image forming units 10M, 10C, and 10K will not be described.

Note that, regarding the second to fourth image forming units 10M, 10C, and 10K, the same components as components of the first image forming unit 10Y are given the same reference numerals as the components of the first image forming unit 10Y. In addition, Y (yellow), M (magenta), C (cyan), or K (black) is added to the ends of reference numerals given to components of the first to fourth image forming units 10Y, 10M, 10C, and 10K.

The first image forming unit 10Y has a photoreceptor 1Y. In the vicinity of the photoreceptor 1Y, in order from an upstream side in a rotation direction of the photoreceptor 1Y, a charging roller 2Y that charges a surface of the photoreceptor 1Y to a predetermined potential, an exposure device 3 that causes the charged surface to be exposed to a laser beam 3Y based on an image signal so as to form an electrostatic latent image, the developing device 4Y that develops the electrostatic latent image with toner, a primary transfer roller 5Y that transfers the developed toner image onto the intermediate transfer belt 20, and a cleaning device 6Y that removes toner remaining on the surface of the photoreceptor 1Y after primary transfer are provided.

Note that the primary transfer roller 5Y is disposed inside the intermediate transfer belt 20 and faces the photoreceptor 1Y with the intermediate transfer belt 20 interposed therebetween. Further, a bias power supply (not shown) that applies a primary transfer bias is connected to the primary transfer roller 5Y.

The image forming apparatus 40 is provided with an accommodation portion 32 that accommodates recording paper P which is an example of a recording medium. In addition, the image forming apparatus 40 is provided with a paper feeding roller 34 that feeds the recording paper P in the accommodation portion 32 and a plurality of transport rollers 36 that transport the recording paper P along a transport path 38.

In addition, the image forming apparatus 40 is provided with a secondary transfer unit 23. The secondary transfer unit 23 includes the intermediate transfer belt 20, the support roller 24 that comes into contact with a rear surface of the intermediate transfer belt 20, and a secondary transfer roller 26 disposed outside the intermediate transfer belt 20. In the secondary transfer unit 23, a toner image that is multilayer-transferred onto the surface 20S of the intermediate transfer belt 20 is transferred onto the recording paper P in a case where a secondary transfer bias is applied to the support roller 24.

The image forming apparatus 40 is provided with a fixation device 28. The fixation device 28 includes a fixation member 52 and a pressing member 54 pressed against the fixation member 52. In a case where the recording paper P passes through a nip portion where the fixation member 52 and the pressing member 54 come into pressure-contact with each other, a toner image that is multilayer-transferred onto the recording paper P is fixed to the recording paper P.

Action of Image Forming Apparatus

Next, an operation of forming a yellow image at the first image forming unit 10Y will be described. A surface of the photoreceptor 1Y is charged by the charging roller 2Y. The surface of the photoreceptor 1Y is irradiated with the laser beam 3Y from the exposure device 3. Accordingly, an electrostatic latent image is formed on the surface of the photoreceptor 1Y.

The electrostatic latent image formed on the surface of the photoreceptor 1Y is visualized as a toner image by the developing device 4Y. The toner image developed on the photoreceptor 1Y is transported to a predetermined primary transfer position. Then, a primary transfer bias is applied to the primary transfer roller 5Y, so that the toner image formed on the surface of the photoreceptor 1Y is transferred onto a surface of the intermediate transfer belt 20. Thereafter, toner (residual toner) remaining on the surface of the photoreceptor 1Y is removed and collected by the cleaning device 6Y.

In addition, in the second to fourth image forming units 10M, 10C, and 10K as well, toner images corresponding to respective colors are formed on surfaces of photoreceptors 1M, 1C, and 1K through the same operation as in the first image forming unit 10Y. The intermediate transfer belt 20 to which a yellow toner image has been transferred at the first image forming unit 10Y is moved to the second to fourth image forming units 10M, 10C, and 10K in order. Then, to the surface 20S of the intermediate transfer belt 20, the toner images of the respective colors that are formed on the surfaces of photoreceptors 1M, 1C, and 1K are multilayer-transferred in a superimposing manner by primary transfer rollers 5M, 5C, and 5K.

The intermediate transfer belt 20 with the surface onto which the four-color toner image has been multilayer-transferred moves to the secondary transfer unit 23. Meanwhile, the recording paper P accommodated in the accommodation portion 32 is fed by the paper feeding roller 34 and is transported to a contact portion between the secondary transfer roller 26 and the surface 20S of the intermediate transfer belt 20 at a predetermined time by the plurality of transport rollers 36. Then, a secondary transfer bias is applied to the support roller 24 and thus the toner image on the surface 20S of the intermediate transfer belt 20 is transferred onto the recording paper P.

After that, the recording paper P is sent to the nip portion where the fixation member 52 and the pressing member 54 come into pressure-contact with each other. Accordingly, the toner image is fixed onto the recording paper P, and a color image is formed. The recording paper P on which fixation of the color image is finished is transported out to a discharge portion and a series of color image forming operations ends.

Cleaning Device

Next, the configuration of the cleaning device 60 will be described in detail.

Figure 2:
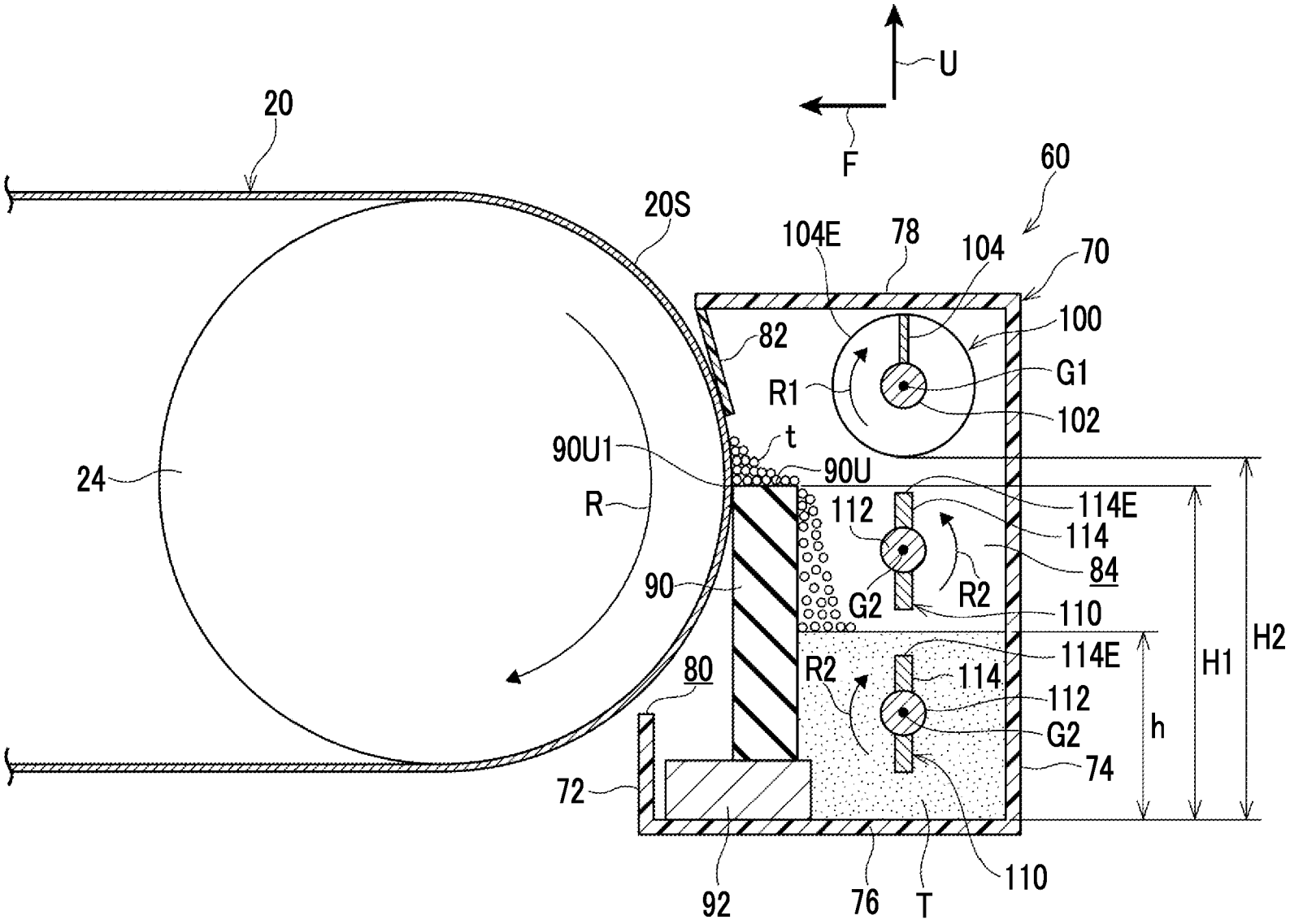
FIG. 2 is an enlarged vertical sectional view of FIG. 1 and shows an example of a cleaning device according to the exemplary embodiment.
Figure 3:
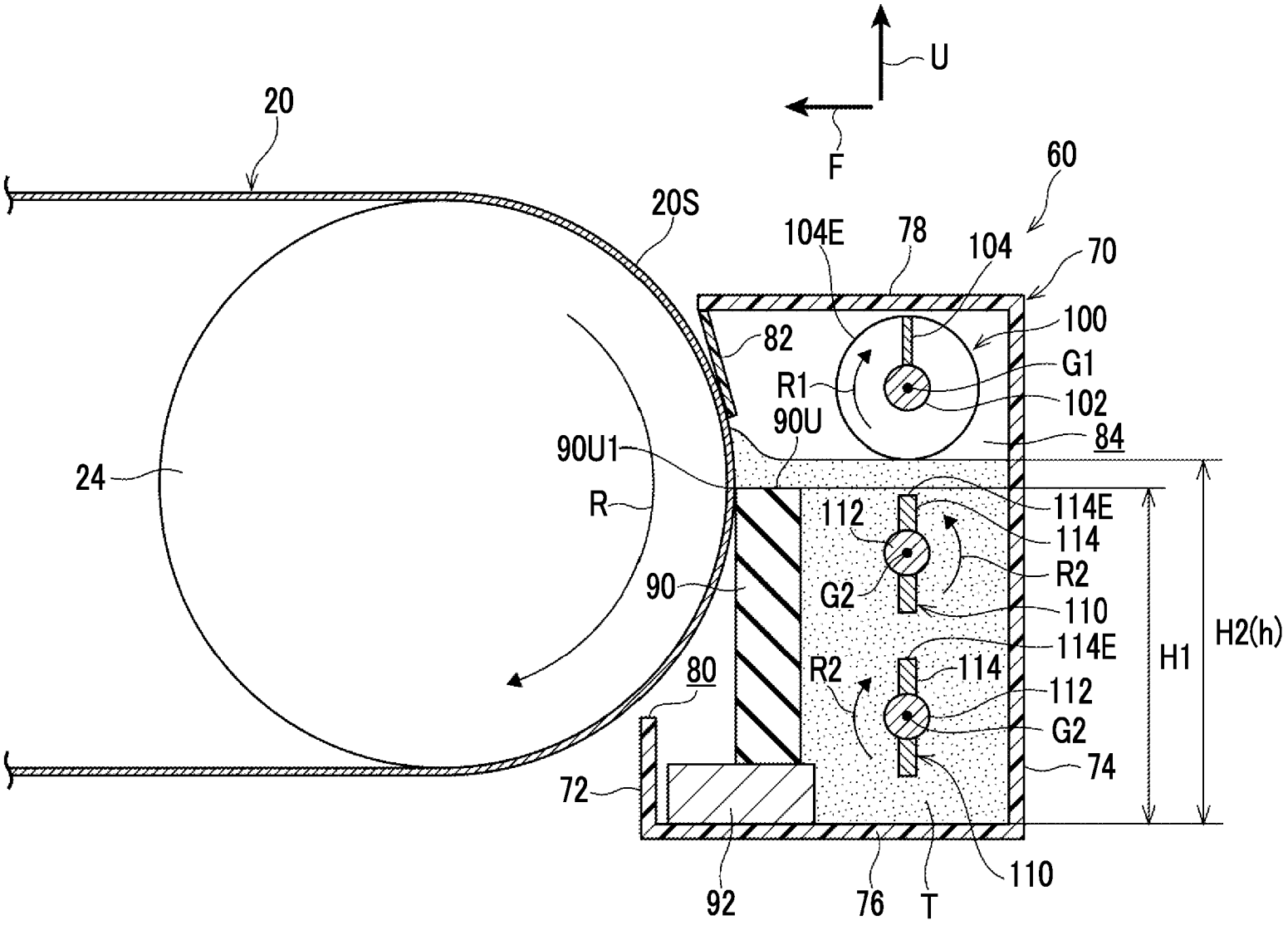
FIG. 3 is an enlarged vertical sectional view of FIG. 1 and shows the example of the cleaning device according to the exemplary embodiment.

As shown in FIGS. 2 and 3, the cleaning device 60 removes toner remaining on the surface 20S of the intermediate transfer belt 20. The cleaning device 60 includes a housing 70, a cleaning member 90, a transport auger 100, and a plurality of stirring augers 110.

An arrow U appropriately shown in each drawing shows an upper side of the cleaning device 60 and an arrow F shows a front side of the cleaning device 60. In addition, the transport auger 100 is an example of a transport member, and the stirring auger 110 is an example of a stirring member.

Housing

The housing 70 is formed of resin, for example. The housing 70 is formed in a straight body shape of which a longitudinal direction is parallel to an axial direction (direction along arrow W in FIG. 4) of a rotary shaft 24A of the intermediate transfer belt 20. Inside the housing 70, a storage chamber 84 for storage of waste toner T, which will be described later, is provided.

The intermediate transfer belt 20 is rotatably supported by the support roller 24. Therefore, in the present exemplary embodiment, the rotary shaft 24A of the support roller 24 is a rotary shaft of the intermediate transfer belt 20.

The housing 70 includes a front wall portion 72, a rear wall portion 74, a bottom wall portion 76, and a top wall portion 78. The front wall portion 72 and the rear wall portion 74 face each other in a front-rear direction (direction along arrow F) of the cleaning device 60. Upper end portions of the front wall portion 72 and the rear wall portion 74 are connected to each other by the top wall portion 78. Meanwhile, lower end portions of the front wall portion 72 and the rear wall portion 74 are connected to each other by the bottom wall portion 76. The bottom wall portion 76 faces the top wall portion 78 in a vertical direction (direction along arrow U).

An opening 80 is formed in a portion of the housing 70 that is on the intermediate transfer belt 20 side, that is, the front wall portion 72 of the housing 70. The opening 80 penetrates the front wall portion 72 in a thickness direction. In addition, the opening 80 is formed in a rectangular shape, and is formed over a range from one end side to the other end side of the housing 70 in the longitudinal direction (direction along arrow W in FIG. 4). A portion of the support roller 24 and a portion of the intermediate transfer belt 20 are disposed inside the housing 70 via the opening 80.

Cleaning Member

The cleaning member (cleaning blade) 90 is formed of an elastic member such as rubber, is formed in a plate shape, and is disposed on a front end side in the housing 70. The cleaning member 90 is disposed along the vertical direction of the housing 70. In addition, a lower end portion of the cleaning member 90 is supported (fixed) by the bottom wall portion 76 of the housing 70 via a bracket 92 such as a metal plate. The cleaning member 90 can be elastically deformed (vibrated) in the thickness direction (front-rear direction of housing 70).

The cleaning member 90 may be disposed along a direction inclined with respect to the vertical direction of the housing 70 instead of being disposed along the vertical direction of the housing 70.

An upper end portion 90U of the cleaning member 90 is a free end portion. In addition, a corner portion (edge portion) of the upper end portion 90U of the cleaning member 90 that is on the intermediate transfer belt 20 side (front side) is a contact portion 90U1 that comes into contact with the surface 20S of the intermediate transfer belt 20. In the housing 70, the contact portion 90U1 comes into contact with the surface 20S of the intermediate transfer belt 20 from a downstream side in the rotation direction (direction along arrow R) of the intermediate transfer belt 20.

In addition, the contact portion 90U1 of the cleaning member 90 comes into contact with the surface 20S of the intermediate transfer belt 20 in a state where the cleaning member 90 is slightly bent toward a rear side of the housing 70 (in state where cleaning member 90 is elastically deformed). A height (length in vertical direction) of the cleaning member 90 is set to a predetermined value or more so that the amount of bending of the cleaning member 90 is secured.

Figure 4:
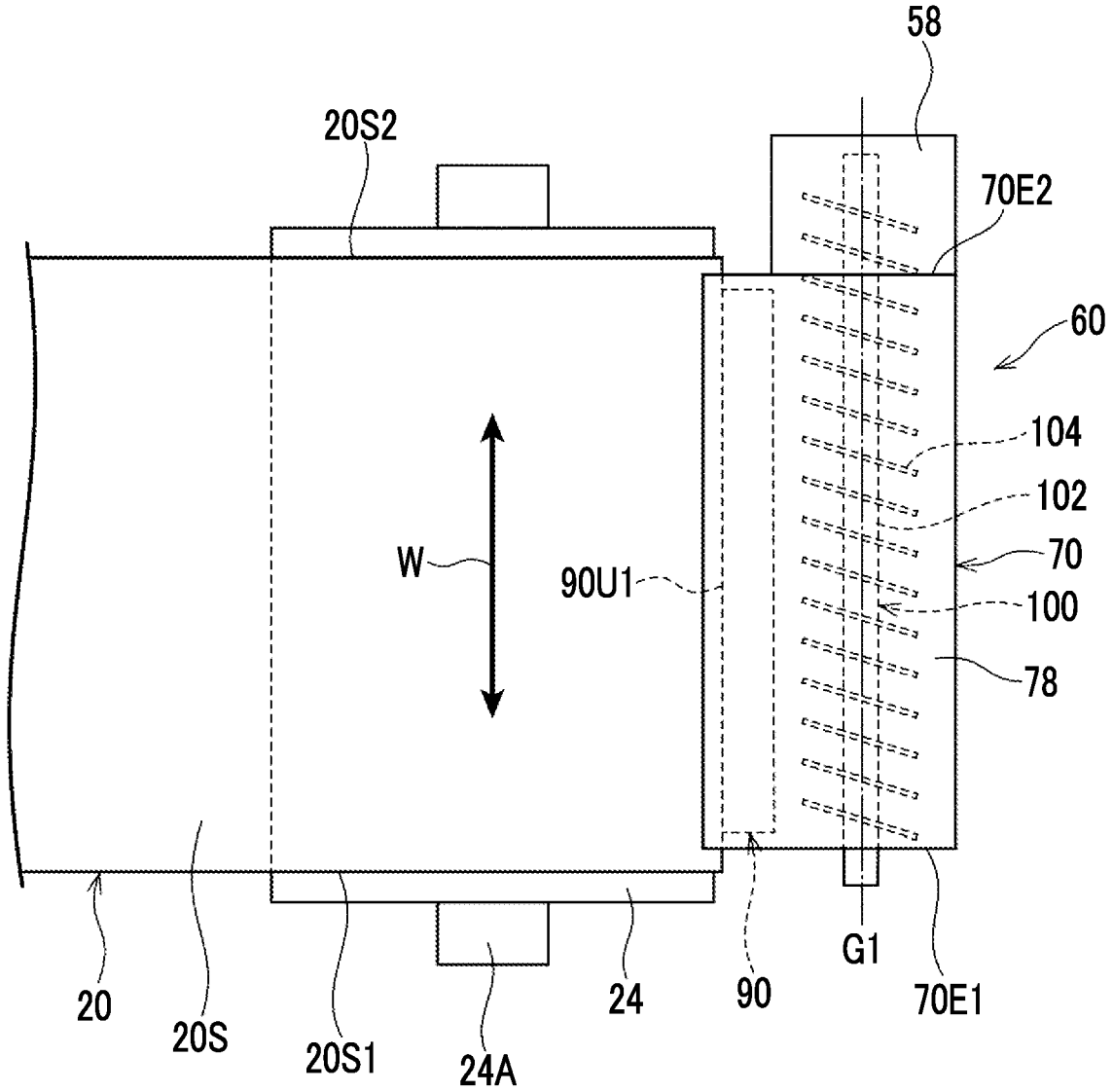
FIG. 4 is a plan view of the cleaning device shown in FIG. 2 as seen from above.

As shown in FIG. 4, the contact portion 90U1 of the cleaning member 90 comes into contact with the surface 20S of the intermediate transfer belt 20 along the axial direction (direction along arrow W) of the rotary shaft 24A. In addition, the contact portion 90U1 of the cleaning member 90 comes into contact with the surface 20S of the intermediate transfer belt 20 over a range from one end 20S1 side to the other end 20S2 side in a width direction (direction along arrow W) of the surface 20S. In addition, the intermediate transfer belt 20 and the cleaning member 90 are disposed over a range from one end side 70E1 and the other end side 70E2 in the longitudinal direction (direction along arrow W) of the housing 70 of the cleaning device 60.

As shown in FIG. 2, the intermediate transfer belt 20 rotates as shown by the arrow R to pass through the contact portion 90U1 of the cleaning member 90 in a direction from an upper side to a lower side. Accordingly, toner (residual toner) remaining on the surface 20S of the intermediate transfer belt 20 is scraped off by the contact portion 90U1 and removed from the surface 20S.

The intermediate transfer belt 20 and the cleaning member 90 face the rear wall portion 74 of the housing 70. The storage chamber 84 is formed between the intermediate transfer belt 20, the cleaning member 90, and the rear wall portion 74 of the housing 70. In addition, toner (hereinafter, referred to as "waste toner T") that is removed from the surface 20S of the intermediate transfer belt 20 by the contact portion 90U1 of the cleaning member 90 falls into the storage chamber 84 from the upper end portion 90U of the cleaning member 90 and is stored in the storage chamber 84.

A seal member 82 is provided at an end portion of the top wall portion 78 of the housing 70, the end portion being on the opening 80 side. The seal member 82 is formed by, for example, a film or the like. In addition, the seal member 82 extends from the end portion of the top wall portion 78 of the housing 70 and covers a gap between the end portion and the surface 20S of the intermediate transfer belt 20. The seal member 82 prevents the waste toner T stored in the storage chamber 84 from flowing out to the outside of the housing 70.

Transport Auger

The transport auger 100 is provided at an upper portion in the housing 70. The transport auger 100 transports the waste toner T to one side in an axial direction along an axis G1 while rotating around the axis G1 so as to transport the waste toner T stored in the storage chamber 84 to the outside of the housing 70, the axis G1 extending along the axial direction of the rotary shaft 24A of the intermediate transfer belt 20.

Specifically, the transport auger 100 is, for example, a screw conveyor with a shaft. In addition, the transport auger 100 is disposed on a side opposite to the intermediate transfer belt 20 with respect to the contact portion 90U1 of the cleaning member 90. The transport auger 100 includes a rotary shaft 102 and a transport blade 104.

The rotary shaft 102 is formed in a columnar shape, and is disposed along the axial direction of the rotary shaft 24A of the intermediate transfer belt 20. In addition, both end portions of the rotary shaft 102 are rotatably supported by bearings (not shown) provided in the housing 70. The rotary shaft 102 rotates around the axis G1 extending along the axial direction (direction along arrow W in FIG. 4) of the rotary shaft 24A of the intermediate transfer belt 20.

The transport blade 104 is formed in a spiral shape centered on the axis G1 and is attached to an outer peripheral surface of the rotary shaft 102. In a case where the transport blade 104 rotates around the axis G1, the waste toner T lifted up by the transport blade 104 is transported to the one side in the axial direction along the axis G1.

As shown in FIG. 4, the waste toner T transported by the transport auger 100 is collected into a waste toner collection box 58. The waste toner collection box 58 is disposed on one side in the longitudinal direction of the housing 70. In the waste toner collection box 58, one end side of the transport auger 100 in the axial direction is disposed. Accordingly, the waste toner T transported by the transport auger 100 is collected into the waste toner collection box 58.

Here, as shown in FIG. 2, the transport auger 100 transports, to the waste toner collection box 58 (refer to FIG. 4) outside the housing 70, the waste toner T stored in the storage chamber 84 in the housing 70 at a position above the contact portion 90U1 of the cleaning member 90.

Specifically, the transport blade 104 of the transport auger 100 is formed in a circular shape as seen in the axial direction of the rotary shaft 102. The waste toner T stored above a lower end of a trajectory of rotation drawn by an outer peripheral edge 104E of the transport blade 104 is transported by the transport blade 104. That is, the waste toner T stored below the lower end of the trajectory of rotation drawn by an outer peripheral edge 104E of the transport blade 104 is stored in the storage chamber 84 without being transported by the transport auger 100.

In addition, in the present exemplary embodiment, the lower end of the trajectory of rotation drawn by the outer peripheral edge 104E of the transport blade 104 is disposed above the contact portion 90U1 of the cleaning member 90. That is, a height H2 between the bottom wall portion 76 of the housing 70 and the lower end of the trajectory of rotation drawn by the outer peripheral edge 104E of the transport blade 104 is larger than a height H1 between the bottom wall portion 76 of the housing 70 and the contact portion 90U1 of the cleaning member 90 (H2>H1).

Accordingly, the waste toner T is stored in the storage chamber 84 until a position (height H2) higher than the height H1 of the contact portion 90U1 of the cleaning member 90 is reached. In addition, in a case where a storage height h of the stored waste toner T reaches the height H1 of the contact portion 90U1 of the cleaning member 90, the contact portion 90U1 of the cleaning member 90 is buried in the waste toner T.

In addition, as shown by an arrow R1, the transport auger 100 rotates around the axis G1 such that a lower end of the transport blade 104 moves toward the contact portion 90U1 of the cleaning member 90 with respect to an upper end of the transport blade 104. Accordingly, the waste toner T lifted up by the transport blade 104 is likely to move toward the contact portion 90U1 of the cleaning member 90.

Note that, the transport auger 100 may rotate around the axis G1 such that the lower end of the transport blade 104 moves toward a side opposite to the contact portion 90U1 of the cleaning member 90 with respect to the upper end of the transport blade 104. In addition, the transport auger 100 is not limited to a screw conveyor with a shaft and may be a shaftless screw conveyor (coil auger) or the like.

Stirring Auger

The plurality of (two in the present exemplary embodiment) stirring augers 110 are provided at a lower portion in the housing 70. The plurality of stirring augers 110 stir the waste toner T stored in the storage chamber 84 below the transport auger 100. In addition, each stirring auger 110 stirs the waste toner T stored in a lower portion of the storage chamber 84 while rotating around an axis G2 extending along the axial direction (direction along arrow W in FIG. 4) of the rotary shaft 24A of the intermediate transfer belt 20.

Specifically, the plurality of stirring augers 110 are disposed in the storage chamber 84 between the rear wall portion 74 of the housing 70 and the cleaning member 90. In addition, the plurality of stirring augers 110 are disposed beside the cleaning member 90 at an interval in the vertical direction. Furthermore, the plurality of stirring augers 110 are disposed such that the stirring auger 110 on an upper side is positioned below the contact portion 90U1 of the cleaning member 90 entirely. Each stirring auger 110 includes a rotary shaft 112 and a plurality of stirring blades 114.

The rotary shaft 112 is formed in a columnar shape, and is disposed along the axial direction of the rotary shaft 24A of the intermediate transfer belt 20. In addition, both end portions of the rotary shaft 112 are rotatably supported by bearings (not shown) provided in the housing 70. The rotary shaft 112 rotates around the axis G2 extending along the axial direction (direction along arrow W in FIG. 4) of the rotary shaft 24A of the intermediate transfer belt 20.

Each of the plurality of (two in the present exemplary embodiment) stirring blades 114 are formed in a plate shape and is disposed along the axial direction along the axis G2. In addition, as seen in the axial direction along the axis G2, the plurality of stirring blades 114 extend radially outward from an outer peripheral surface of the rotary shaft 112 while being centered on the axis G2. In a case where the transport blades 104 rotate around the axis G2, the waste toner T is lifted up and stirred by the stirring blades 114. Note that the stirring auger 110 stirs the waste toner T without transporting the waste toner T in the axial direction along the axis G2.

As shown by an arrow R2, the stirring augers 110 that are adjacent to each other in the vertical direction rotate in opposite directions around the respective axes G2. Accordingly, the waste toner T is stirred in one direction (direction opposite to direction along arrow F) between the stirring augers 110 that are adjacent to each other in the vertical direction.

In addition, the transport auger 100 and the stirring auger 110 that are adjacent to each other in the vertical direction rotate in opposite directions around the respective axes G1 and G2. Accordingly, the waste toner T is stirred in one direction (direction along arrow F) between the transport auger 100 and the stirring auger 110 that are adjacent to each other in the vertical direction.

Note that the stirring augers 110 that are adjacent to each other in the vertical direction may rotate in the same direction around the respective axes G2. Similarly, the transport auger 100 and the stirring auger 110 that are adjacent to each other in the vertical direction may rotate in the same direction around the respective axes G1 and G2.

Action

Next, the action of the cleaning device according to the present exemplary embodiment will be described.

As shown in FIG. 2, the contact portion 90U1 of the cleaning member 90 comes into contact with the surface 20S of the intermediate transfer belt 20 from the downstream side in the rotation direction of the intermediate transfer belt 20. In a case where the intermediate transfer belt 20 rotates in a direction along the arrow R in such a state, toner remaining on the surface 20S of the intermediate transfer belt 20 is scraped off by the contact portion 90U1 of the cleaning member 90. Toner t scraped off by the contact portion 90U1 of the cleaning member 90 temporarily stays at the contact portion 90U1 and then is stored into the storage chamber 84 in the housing 70 over the upper end portion 90U of the cleaning member 90.

Here, the toner t temporarily staying at the contact portion 90U1 functions as a lubricant that reduces a frictional force generated between the surface 20S of the intermediate transfer belt 20 and the contact portion 90U1 of the cleaning member 90. Accordingly, the contact portion 90U1 of the cleaning member 90 being dragged by the surface 20S of the intermediate transfer belt 20 in the rotation direction (direction along arrow R) of the intermediate transfer belt 20 is suppressed.

Meanwhile, for example, in a case where a low-resolution low-density image is continuously printed, the amount of toner remaining on the surface 20S of the intermediate transfer belt 20 is reduced. As a result, the amount of the toner t staying at the contact portion 90U1 of the cleaning member 90 is reduced, and a frictional force generated between the surface 20S of the intermediate transfer belt 20 and the contact portion 90U1 of the cleaning member 90 is increased.

Accordingly, the contact portion 90U1 of the cleaning member 90 may be dragged by the surface 20S of the intermediate transfer belt 20 in the rotation direction (direction along arrow R) of the intermediate transfer belt 20 and the cleaning member 90 may be bent to be rolled up. In addition, in a case where the cleaning member 90 is bent to be rolled up, the removal efficiency of the cleaning member 90 which removes toner remaining on the surface 20S of the intermediate transfer belt 20 may be decreased and the surface 20S of the intermediate transfer belt 20 may be poorly cleaned.

On the other hand, in the present exemplary embodiment, the transport auger 100 is provided above the storage chamber 84 of the housing 70. Here, as shown in FIG. 2, the transport auger 100 transports, to the waste toner collection box 58 (refer to FIG. 4) outside the housing 70, the waste toner T stored in the storage chamber 84 in the housing 70 at a position above the contact portion 90U1 of the cleaning member 90 that comes into contact with the surface 20S of the intermediate transfer belt 20.

Accordingly, as shown in FIGS. 2 and 3, the waste toner T is stored in the storage chamber 84 until a position (height H2) higher than the height H1 of the contact portion 90U1 of the cleaning member 90 is reached. In addition, in a case where the storage height h of the stored waste toner T reaches the height H1 of the contact portion 90U1 of the cleaning member 90, the contact portion 90U1 of the cleaning member 90 is constantly buried in the waste toner T. That is, a state where the waste toner T as a lubricant is constantly supplied to the contact portion 90U1 of the cleaning member 90 is achieved.

Therefore, in the case of the present exemplary embodiment, an increase in frictional force generated between the surface 20S of the intermediate transfer belt 20 and the contact portion 90U1 of the cleaning member 90 is suppressed even in a case where a low-resolution low-density image is continuously printed in comparison with a case where the storage height h of the waste toner T is smaller than the height H1 of the contact portion 90U1 of the cleaning member 90.

As a result, a probability that the contact portion 90U1 of the cleaning member 90 is dragged by the surface 20S of the intermediate transfer belt 20 in the rotation direction (direction along arrow R) of the intermediate transfer belt 20 and the cleaning member 90 is bent to be rolled up is suppressed. Therefore, poor cleaning of the surface 20S of the intermediate transfer belt 20 is suppressed.

In addition, in the present exemplary embodiment, the waste toner T removed from the surface 20S of the intermediate transfer belt 20 is supplied, as a lubricant, to the contact portion 90U1 of the cleaning member 90. Therefore, in the case of the present exemplary embodiment, the amount of toner to be used may be reduced and poor cleaning of the intermediate transfer belt 20 may be suppressed in comparison with a configuration in which toner different from toner removed from the surface 20S of the intermediate transfer belt 20 is supplied to, as a lubricant material, the contact portion 90U1 of the cleaning member 90.

Note that, until the storage height h of the waste toner T stored in the storage chamber 84 reaches the height H1 of the contact portion 90U1 of the cleaning member 90, an event as follows occurs, for example. That is, independently of the above-described color image forming operations of the image forming apparatus 40, toner is supplied to a region (region from which no transfer to recording paper P occurs) other than a toner image forming region on the surface 20S of the intermediate transfer belt 20 from at least one of the first to fourth image forming units 10Y, 10M, 10C, or 10K at a predetermined time. Accordingly, for example, an increase in frictional force generated between the surface 20S of the intermediate transfer belt 20 and the contact portion 90U1 of the cleaning member 90 is suppressed even in a case where a low-resolution low-density image is continuously printed.

In addition, the transport auger 100 transports the waste toner T to the one side in the axial direction along the axis G1 while rotating around the axis G1 extending along the axial direction of the rotary shaft 24A of the intermediate transfer belt 20. Accordingly, in the case of the present exemplary embodiment, the size of the housing 70 may be reduced in comparison with a configuration in which the transport auger 100 transports the waste toner T in a direction different from the axial direction along the axis G1.

Furthermore, as shown by the arrow R1, the transport auger 100 rotates around the axis G1 such that a lower end of the transport auger 100 moves toward the contact portion 90U1 with respect to an upper end of the transport auger 100. Accordingly, in the case of the present exemplary embodiment, the waste toner T is easily supplied to the contact portion 90U1 of the cleaning member 90 in comparison with a configuration in which the transport auger 100 rotates around the axis G1 such that the lower end of the transport auger 100 moves toward a side (side opposite to arrow R1) opposite to the contact portion 90U1 of the cleaning member 90 with respect to the upper end of the transport auger 100.

In addition, the cleaning member 90 is disposed along the vertical direction as seen in the axial direction of the rotary shaft 24A of the intermediate transfer belt 20. Accordingly, in the case of the present exemplary embodiment, the size of the housing 70 may be reduced in comparison with a configuration in which the cleaning member 90 is disposed along a direction inclined with respect to the vertical direction as seen in the axial direction of the rotary shaft 24A of the intermediate transfer belt 20.

In addition, the plurality of stirring augers 110 are provided in the storage chamber 84 of the housing 70. Below the transport auger 100, the plurality of stirring augers 110 stir the waste toner T stored in the storage chamber 84 while rotating around the respective axes G2. Accordingly, in the case of the present exemplary embodiment, adhesion of the waste toner T is suppressed in comparison with a configuration in which the waste toner T is simply stored in the storage chamber 84 of the housing 70.

Furthermore, as shown by the arrow R2, the stirring augers 110 that are adjacent to each other in the vertical direction rotate in opposite directions around the respective axes G2. Accordingly, in the case of the present exemplary embodiment, adhesion of the waste toner T is suppressed between the stirring augers 110 adjacent to each other in comparison with a configuration in which the stirring augers 110 adjacent to each other rotate in the same direction.

Furthermore, as shown by the arrow R1 and the arrow R2, the transport auger 100 and the stirring auger 110 that are adjacent to each other in the vertical direction rotate in opposite directions. Accordingly, in the case of the present exemplary embodiment, adhesion of the waste toner T is suppressed between the transport auger 100 and the stirring auger 110 in comparison with a configuration in which the transport auger 100 and the stirring auger 110 rotate in the same direction.

Here, in a case where the intermediate transfer belt 20 rotates in a state where the contact portion 90U1 of the cleaning member 90 is in contact with the surface 20S of the intermediate transfer belt 20, the cleaning member 90 vibrates (is elastically deformed) in the front-rear direction (direction along arrow F) of the housing 70. Accordingly, in the case of the present exemplary embodiment, the removal efficiency of the cleaning member 90 which removes toner remaining on the surface 20S of the intermediate transfer belt 20 is improved in comparison with a configuration in which the cleaning member 90 does not vibrate in the front-rear direction of the housing 70.

Meanwhile, in a case where adhesion of the waste toner T stored in the storage chamber 84 beside the cleaning member 90 occurs, it becomes difficult for the cleaning member 90 to vibrate in the front-rear direction of the housing 70. As a result, the removal efficiency of the cleaning member 90 which removes toner on the surface 20S of the intermediate transfer belt 20 may be decreased.

With regard to this, in the present exemplary embodiment, the stirring augers 110 are disposed in the storage chamber 84 between the cleaning member 90 and the rear wall portion 74 of the housing 70. That is, the stirring augers 110 are disposed beside the cleaning member 90. Accordingly, in the case of the present exemplary embodiment, adhesion of the waste toner T beside the cleaning member 90 is suppressed in comparison with a configuration in which the stirring augers 110 are disposed above the cleaning member 90. Therefore, a decrease in removal efficiency of the cleaning member 90 which removes toner on the surface 20S of the intermediate transfer belt 20 is suppressed.

In addition, the plurality of stirring augers 110 are disposed beside the cleaning member 90 in the vertical direction. Accordingly, in the case of the present exemplary embodiment, adhesion of the waste toner T beside the cleaning member 90 is suppressed in comparison with a configuration in which one stirring auger 110 is disposed beside the cleaning member 90.

Furthermore, beside the cleaning member 90, the plurality of stirring augers 110 are disposed such that the stirring auger 110 on the upper side is positioned below the contact portion 90U1 of the cleaning member 90 entirely. Accordingly, in the case of the present exemplary embodiment, adhesion of the waste toner T beside the cleaning member 90 is suppressed in comparison with a configuration in which the stirring auger 110 on the upper side is disposed above the contact portion 90U1 of the cleaning member 90 entirely or partially.

Modification Example

Next, a modification example of the above-described exemplary embodiment will be described.

Figure 5:
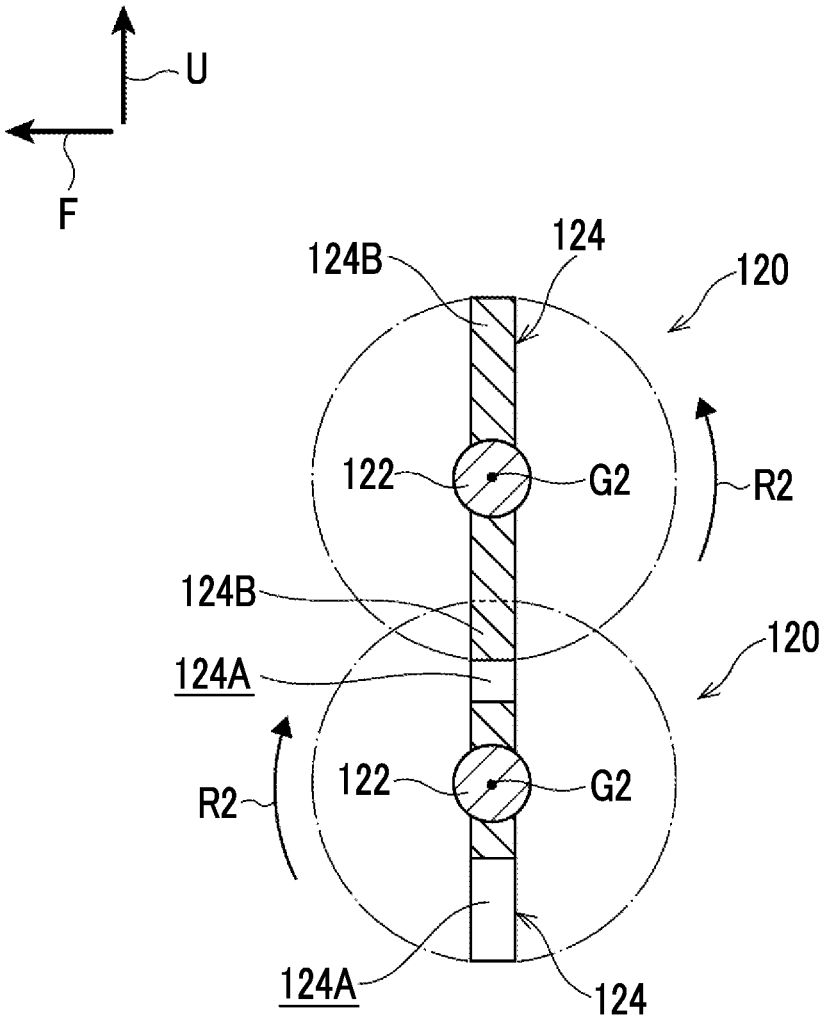
FIG. 5 is a cross-sectional view taken along line 5-5 of FIG. 6.

FIG. 5 shows stirring augers 120 that are adjacent to each other in the vertical direction. Each stirring auger 120 includes a rotary shaft 122 and comb-shaped stirring blades 124 extending in an axial direction of the rotary shaft 122. The stirring augers 120 adjacent to each other are disposed such that trajectories of rotation of the respective comb-shaped stirring blades 124 overlap with each other as seen in an axial direction along the axis G2 as shown by two-dot chain lines. The stirring auger 120 is an example of a stirring member.

Figure 6:
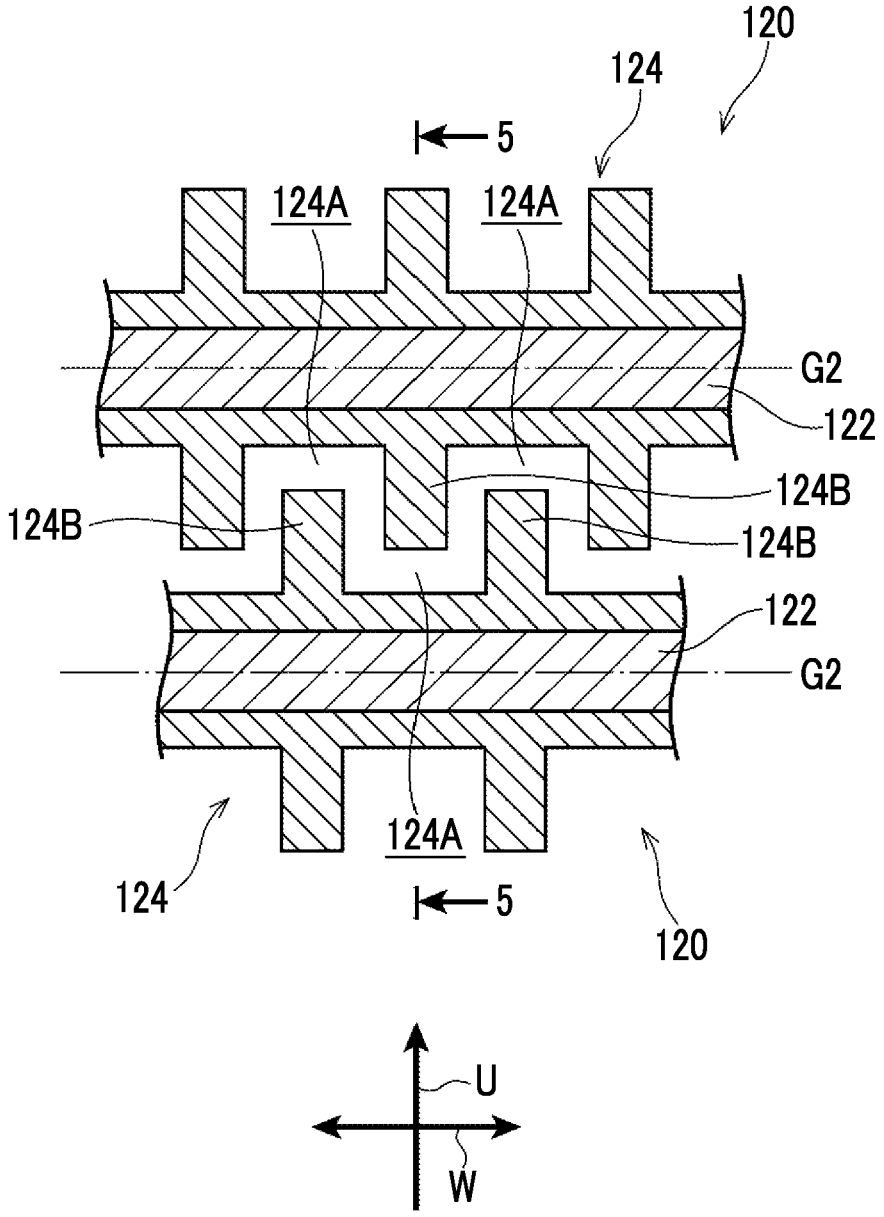
FIG. 6 is a cross-sectional view of a modification example of a stirring auger according to the exemplary embodiment which is cut along an axial direction.

As shown in FIG. 6, the comb-shaped stirring blade 124 includes a plurality of recess portions 124A and protrusion portions 124B alternately arranged in the axial direction of the rotary shaft 122. Regarding the stirring augers 120 adjacent to each other, the protrusion portions 124B of the respective comb-shaped stirring blades 124 are disposed so as to be offset from each other in the axial direction along the axis G2 so that interference therebetween is prevented. Accordingly, in a case where the stirring augers 120 adjacent to each other rotate around the respective axes G2, the protrusion portions 124B of one stirring auger 120 pass through the recess portions 124A of the other stirring auger 120.

As described above, in the present modification example, the trajectories of rotation of the comb-shaped stirring blades 124 of the stirring augers 120 adjacent to each other are disposed to overlap with each other as seen in the axial direction along the axes G2 of the stirring augers 120. Accordingly, in the case of the present exemplary embodiment, the size of a region where the waste toner T is not stirred is reduced in comparison with a configuration in which the trajectories of rotation of the comb-shaped stirring blades 124 of the stirring augers 120 adjacent to each other are separated from each other in the vertical direction as seen in the axial direction along the axes G2 of the stirring augers 120.

Note that, in a case where the trajectories of rotation of the comb-shaped stirring blades 124 of the stirring augers 120 adjacent to each other overlap with each other as seen in the axial direction along the axes G2 of the stirring augers 120 as in the present modification example, three stirring augers 120 can be disposed in the vertical direction in the housing 70 shown in FIG. 2, for example. Therefore, adhesion of the waste toner T stored in the storage chamber 84 of the housing 70 is further suppressed.

In addition, in the above-described exemplary embodiment, stirring forces of the stirring augers 110 adjacent to each other are the same as each other. However, for example, it is preferable that a stirring force of one of the plurality of stirring augers 110 that is positioned at a lowermost position is larger than stirring forces of the other stirring augers 110.

Here, a stirring force of the stirring auger 110 means an external force that acts on the waste toner T from the stirring blade 114 of the stirring auger 110 as the stirring auger 110 rotates and the larger the stirring force of the stirring auger 110 is, the larger a stirring range of the stirring auger 110 is. The stirring force of the stirring auger 110 increases as a circumferential speed of an outer peripheral edge 114E of the stirring blade 114 increases.

Therefore, for example, in a case where two stirring augers 110 are disposed in the vertical direction as shown in FIG. 2, a rotation speed of the stirring auger 110 on a lower side is made higher than a rotation speed of the stirring auger 110 on an upper side. Alternatively, a radial length of the stirring blade 114 of the stirring auger 110 on the lower side is made larger than a radial length of the stirring blade 114 of the stirring auger 110 on the upper side in a state where the rotation speeds of the stirring augers 110 on the upper and lower sides are the same as each other. Alternatively, the rotation speed of the stirring auger 110 on the lower side is made higher than the rotation speed of the stirring auger 110 on the upper side and the radial length of the stirring blade 114 of the stirring auger 110 on the lower side is made larger than the radial length of the stirring blade 114 of the stirring auger 110 on the upper side.

Accordingly, a circumferential speed of the outer peripheral edge 114E of the stirring blade 114 of the stirring auger 110 on the lower side is made higher than a circumferential speed of the outer peripheral edge 114E of the stirring blade 114 of the stirring auger 110 on the upper side. As a result, a stirring force of the stirring auger 110 on the lower side is made larger than a stirring force of the stirring auger 110 on the upper side, and a stirring range of the stirring auger 110 on the lower side is made larger than a stirring range of the stirring auger 110 on the upper side.

Therefore, in the case of the present modification example, adhesion of the waste toner T stored in the lower portion of the storage chamber 84 is suppressed in comparison with a configuration in which the stirring forces of the stirring augers 110 adjacent to each other are the same as each other.

In addition, in the above-described exemplary embodiment, the transport auger 100 transports the waste toner T stored in the storage chamber 84 in the housing 70 to the outside of the housing 70 at a position above the contact portion 90U1 of the cleaning member 90. However, the transport auger 100 may transport the waste toner T stored in the storage chamber 84 in the housing 70 to the outside of the housing 70 at the same height as the contact portion 90U1 of the cleaning member 90. That is, the height H2 of the lower end of the trajectory of rotation drawn by the outer peripheral edge 104E of the transport blade 104 may be the same as the height H1 of the contact portion 90U1 of the cleaning member 90 (H2=H1).

In addition, in the above-described exemplary embodiment, the housing 70 is provided with the plurality of stirring augers 110. However, the housing 70 may be provided with at least one stirring auger 110. In addition, for example, it is desirable that at least a portion of the stirring auger 110 is positioned below the contact portion 90U1 of the cleaning member 90 for suppression of adhesion of the waste toner T beside the cleaning member 90. Note that, the stirring auger 110 only has to be provided as needed and may be omitted as appropriate.

In addition, in the above-described exemplary embodiment, an image holder is the intermediate transfer belt 20. However, the image holder is not limited to the intermediate transfer belt 20, and may be a direct transfer belt or a photoreceptor.

Although one exemplary embodiment of the present disclosure has been described above, the present disclosure is not limited to such an exemplary embodiment, the one exemplary embodiment and various modification examples may be used in combination as appropriate, and it is a matter of course that various exemplary embodiments can be implemented without departing from the gist of the present disclosure.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A cleaning device comprising:

a cleaning member that removes toner from a surface of an image holder by bringing an upper end portion into contact with the surface from a downstream side in a rotation direction of the image holder;

a housing that supports the cleaning member and that stores the toner removed from the surface of the image holder by the cleaning member; and a transport member that is provided in the housing and that transports the toner stored in the housing to an outside of the housing at the same height as a contact portion of the cleaning member that comes into contact with the surface of the image holder or at a position above the contact portion.

2. The cleaning device according to claim 1, wherein the contact portion of the cleaning member comes into contact with the surface of the image holder along an axial direction of the image holder; and the transport member transports the toner to one side in an axial direction along an axis while rotating around the axis, the axis extending along an axial direction of a rotary shaft of the image holder.

3. The cleaning device according to claim 2, wherein the transport member is disposed on a side opposite to the image holder with respect to the contact portion of the cleaning member and rotates around the axis such that a lower end of the transport member moves toward the contact portion with respect to an upper end of the transport member.

4. The cleaning device according to claim 3, further comprising:

a stirring member that is provided in the housing and that stirs the toner stored in the housing below the transport member.

5. The cleaning device according to claim 4, wherein at least a portion of the stirring member is disposed below the contact portion of the cleaning member and stirs the toner while rotating around the axis extending along the axial direction of the rotary shaft of the image holder.

6. The cleaning device according to claim 5, wherein a plurality of stirring members are provided in a vertical direction.

7. The cleaning device according to claim 6, wherein the stirring members that are adjacent to each other rotate in opposite directions.

8. The cleaning device according to claim 2, further comprising:

a stirring member that is provided in the housing and that stirs the toner stored in the housing below the transport member.

9. The cleaning device according to claim 8, wherein at least a portion of the stirring member is disposed below the contact portion of the cleaning member and stirs the toner while rotating around the axis extending along the axial direction of the rotary shaft of the image holder.

10. The cleaning device according to claim 9, wherein a plurality of stirring members are provided in a vertical direction.

11. The cleaning device according to claim 10, wherein the stirring members that are adjacent to each other rotate in opposite directions.

12. The cleaning device according to claim 1, further comprising:

a stirring member that is provided in the housing and that stirs the toner stored in the housing below the transport member.

13. The cleaning device according to claim 12, wherein at least a portion of the stirring member is disposed below the contact portion of the cleaning member and stirs the toner while rotating around an axis extending along an axial direction of a rotary shaft of the image holder.

14. The cleaning device according to claim 13, wherein a plurality of stirring members are provided in a vertical direction.

15. The cleaning device according to claim 14, wherein the stirring members that are adjacent to each other rotate in opposite directions.

16. The cleaning device according to claim 14, wherein the stirring member includes comb-shaped stirring blades that extend in an axial direction of a rotary shaft of the image holder; and the stirring members adjacent to each other are disposed such that the comb-shaped stirring blades of one of the stirring members pass through gaps between the comb-shaped stirring blades of the other of the stirring members.

17. The cleaning device according to claim 14, wherein a stirring force of one of the plurality of stirring members that is positioned at a lowermost position is larger than a stirring force of the other of the stirring members.

18. The cleaning device according to claim 13, wherein the transport member transports the toner while rotating around the axis extending along the axial direction of the rotary shaft of the image holder; and the stirring member adjacent to the transport member rotates in a direction opposite to a direction in which the transport member rotates.

19. The cleaning device according to claim 1, wherein the cleaning member is disposed along a vertical direction as seen in an axial direction of a rotary shaft of the image holder.

20. An image forming apparatus comprising:

an intermediate transfer belt as the image holder; and the cleaning device according to claim 1 that removes toner from a surface of the intermediate transfer belt.

* * * * *